United States Patent [19]

Jones

[11] Patent Number: 4,810,372

[45] Date of Patent: Mar. 7, 1989

[54] DRY MATERIAL SEPARATOR

[75] Inventor: Bradley N. Jones, Yorba Linda, Calif.

[73] Assignee: Sweco, Incorporated, Los Angeles, Calif.

[21] Appl. No.: 936,202

[22] Filed: Dec. 1, 1986

[51] Int. Cl.[4] ..... B07B 1/30

[52] U.S. Cl. ..... 209/315; 209/323; 209/382

[58] Field of Search ..... 209/255, 261, 257, 316, 209/317, 323, 382, 385, 387, 315

[56] References Cited

U.S. PATENT DOCUMENTS

| | | | |
|---|---|---|---|
| 979,685 | 12/1910 | Mumford | 209/323 |
| 1,572,112 | 2/1926 | Forgeson | 209/323 |
| 2,296,293 | 9/1942 | Naeher | 209/322 |
| 2,576,746 | 11/1951 | Barnes | 209/323 |
| 3,366,239 | 1/1968 | Swallow | 209/332 |
| 3,485,363 | 12/1969 | Talley, Jr. | 209/316 |
| 3,653,505 | 4/1972 | Phippen | 209/316 |
| 3,719,277 | 3/1973 | Michael | 209/317 |
| 3,960,731 | 6/1976 | Brandt | 209/303 |
| 4,540,485 | 9/1985 | Lanerie | 209/323 |

FOREIGN PATENT DOCUMENTS

| | | | |
|---|---|---|---|
| 650578 | 10/1962 | Canada | 209/127 |
| 8237 | 3/1889 | United Kingdom | 209/261 |

*Primary Examiner*—Robert B. Reeves
*Assistant Examiner*—Donald T. Hajec
*Attorney, Agent, or Firm*—Lyon & Lyon

[57] ABSTRACT

A vibratory screening apparatus for dry, very fine material. A vibratory housing is employed with parallel screening elements disposed across the housing and spaced vertically. The lower screening element has a much finer mesh size than the upper screening element. The housing includes an opening laterally from between the two screening elements for discharge of material not passing through the lower screen. Sliders are positioned between the screens which have a flat lower surface for riding directly on the lower screen and extend a major portion of the distance between the upper and lower screens.

1 Claim, 1 Drawing Sheet

DRY MATERIAL SEPARATOR

BACKGROUND OF THE INVENTION

The field of the present invention is vibratory separation of dry, fine material.

Vibratory separators have long been used for the separation of both dry and wet materials. Such separators may be circular or rectangular in cross section. They generally include housings which are mounted resiliently and which include a vibration generating device. Screens are fixed to the vibratory housings in substantially horizontal orientation such that material fed to the vibrating screens will be properly screened. Various vibratory motions may be employed to work the material on the screen in the most advantageous manner. Frequently discharge openings are provided both above the screening mechanism and below for retrieving the separated materials.

A variety of devices have been employed to enhance separation using such devices. One such mechanism is to employ two screens in parallel. A finer screen is placed above a courser screen or perforated plate. Sliders are positioned between the screens. The sliders have a flat surface to ride on the lower screen or perforated plate and extend upwardly to adjacent the upper screen. The sliders provide some momentum when banging against the upper screen and provide some sheering action on material hanging through the screen. These devices are often referred to as self-cleaning screen assemblies. The object of such device is to provide enhanced screening on the upper screen with minimum blinding. The lower screen or perforated plate is designed to hold the sliders in position.

Another mechanism which has been employed to enhance screening is to provide brushes having either bristles or rubber flaps extend to the surface of the upper fine mesh screen. The brushes move about the upper surface to help prevent blinding of the screen.

The screening of fine grained or powder-like materials in the dry state has been a substantial source of problems with vibratory screening devices. The terminal velocity of very small particles is so low in atmosphere that it is very difficult to screen the material. Forces between particles also come to interfere with the separation and screening process. As an example, alumina powder made up of 100 micron size particles can be sifted through a 150 micron mesh vibrating screen at 10 times the rate of alumina powder made of 1 micro size particles through the same mesh size.

SUMMARY OF THE INVENTION

The present invention is directed to improved screening of fine, dry powders. To this end, two screening elements are provided in parallel with slider mechanisms therebetween. The lower screening element is of significantly finer mesh than the upper screening element. Material passing through the upper screening element is deposited on the screen below where the sliders are able to break up and physically aid in the passage of that material as small particles through the lower screening element. Oversized particles not able to pass through the lower screening element are then allowed to move outwardly to a discharge from between the screening elements. Thus, an actual separation occurs at the lower screening element with the movement of very fine particles through that lower screening element being enhanced by the slider action. Significant increases in throughout of screen material have been experienced. In some applications, one magnitude improvement in flow has been realized.

Accordingly, it is an object of the present invention to provide an improved mechanism for screening fine, dry particles. Other and further objects and advantages will appear hereinafter.

DETAILED DESCRIPTION OF THE PREFERRED EMBODIMENT

Figure 2:
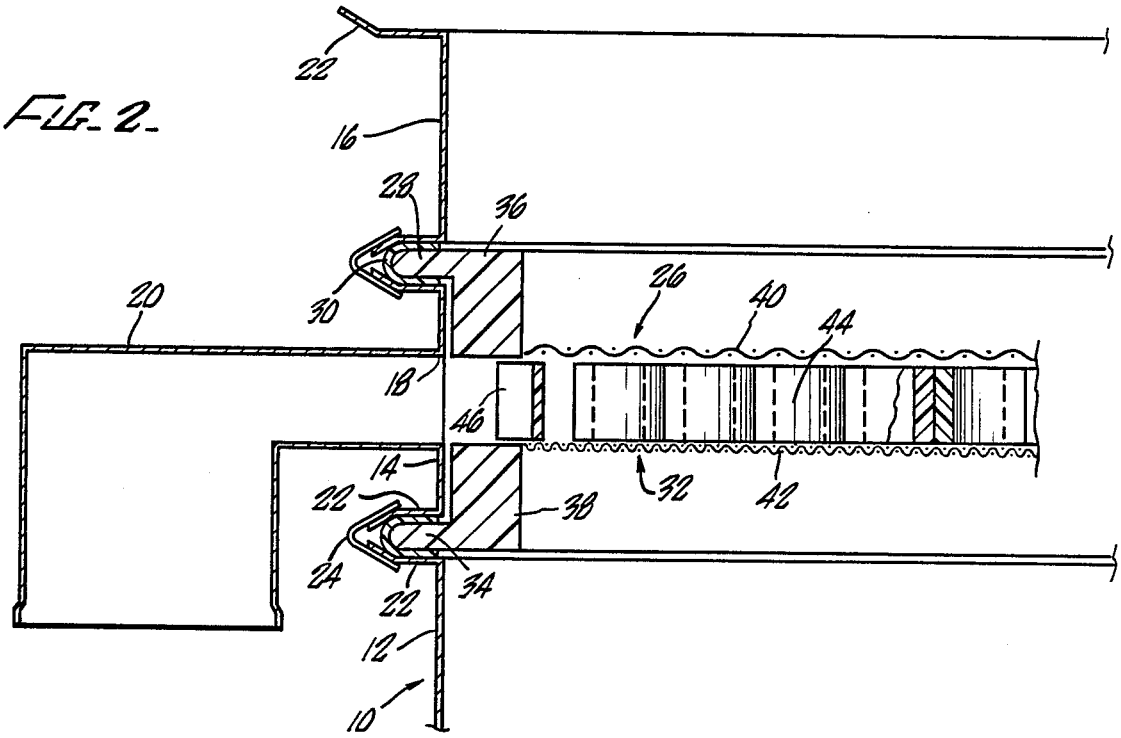
FIG. 2 is a cross-sectional taken along line 2—2 of FIG. 1.
Figure 1:
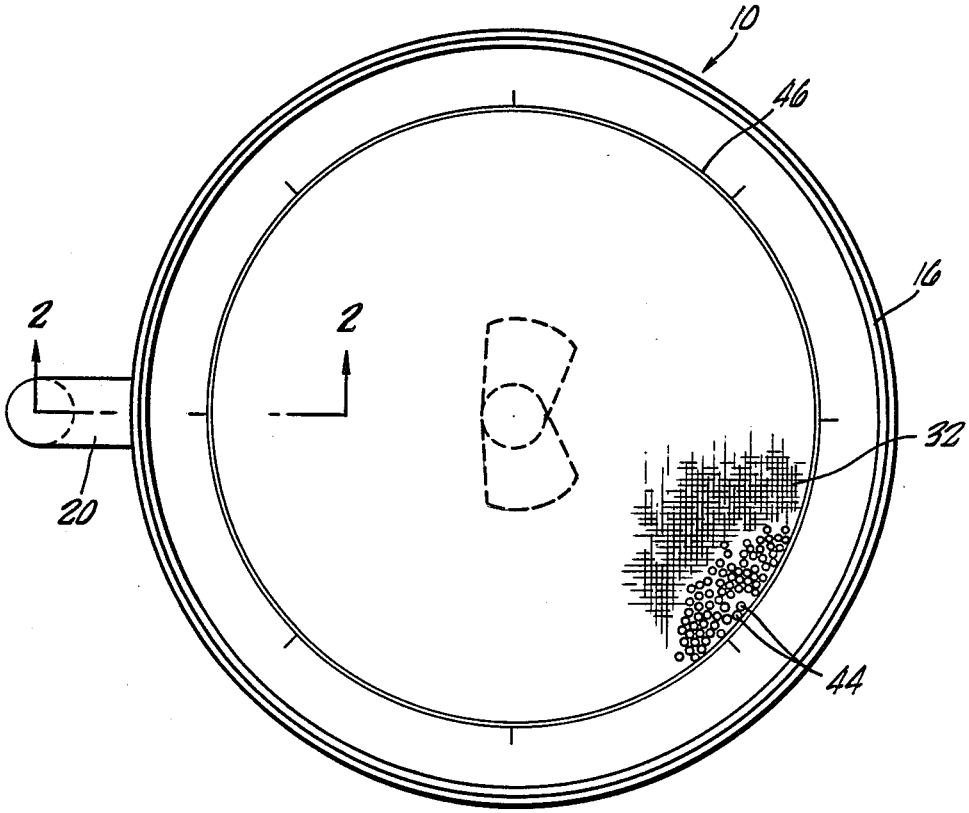
FIG. 1 is a plan view of a separator mechanism illustrating the device with the upper screening element removed for clarity.

Turning in detail to the drawings, a dry material vibratory screen structure is disclosed. The structure includes a vibratory housing, generally designated 10. The housing is shown to be generally cylindrical but may be of other cross-sectional shapes as well. The housing includes a lower cylindrical structure 12, a middle cylindrical structure 14 and an upper cylindrical structure 16. The lower cylindrical structure 12 would include a conventional means for discharge and would be supported on a table (not shown) which was resiliently mounted to a base (not shown). Conventional vibrators may then be employed for inducing a preferred vibration in the lower cylindrical structure 12. The middle cylindrical structure 14 includes a discharge opening 18 with a spout 20. The discharge opening 18 is rectangular. The upper cylindrical structure is a basic plain cylinder and may be used to accommodate or mount a top or other structure.

The cylindrical structures 12, 14 and 16 are held together by means of mounting flanges 22. The mounting flanges are held together by a channeled band clamp 24 which, when placed over the mounting flanges 22 and tightened, will act to draw them toward one another.

Mounted between adjacent flanges 22 on the inner portion of the housing are screening elements. An upper screening element 26 is shown to include an outwardly extending flange 28 which is positioned between adjacent mounting flanges 22. A resilient channel 30 is positioned over the outwardly extending flange 28 to provide an appropriate retaining and sealing mechanism therefor. A lower screening element 32 also includes an outwardly extending flange 34 which is similarly mounted.

The upper screening element 26 and the lower screening element 32 are arranged one above the other in the vibratory housing 10 in substantially parallel arrangement. The upper screening element 26 is of relatively large mesh size compared to the lower screening element 32. The mesh sizes are designed and selected to allow easy flow of fine, dry particles through the upper screening element 26. The lower screening element 32 is selected for the appropriate screening function on the fine particles. Each of the screening elements 26 and 32 include a frame 36 and 38, respectively, and screen cloth 40 and 42, respectively.

Located between the upper screen 26 and the lower screen 32 are sliders 44. The sliders 44 typically have a flat lower surface so that they might rest on the lower screening element 32 and easily slide back and forth responsive to vibration of the housing 10. The sliders also extend upwardly to near the upper screening element 26. It is advantageous that the sliders 44 have some degree of freedom between the screens in order that they may jump up and down to a limited extent and move freely on the lower screen. It is preferred that the layer of material being screened not become any deeper than about a quarter of an inch. Furthermore, it is undesirable to have the sliders jumping up and landing on the body of material lying on the screen such that it would tend to compact the material rather than cause it to pass through the screen itself. For convenience, cylindrical sliders have been employed.

Outwardly of the sliders a slider retaining ring 46 may be employed. The slider retaining ring 46 prevents sliders from traveling all of the way to the edge of the screening device where they can more readily deteriorate the screen structure. Thus, where rapid screen wear is encountered, such a ring might be employed.

The mechanism by which the sliders greatly improve the through put of the lower screening element is unclear. It is believed that the horizontal sliding action of the sliders 44 causes some shear effect on the fluidized powder mass. This would temporarily break weak particle-to-particle bonds and therefore allow particles to move through the lower screen. It is also believed that the up and down action of the rings may drive particles down through the mesh. Finally, the horizontal sliding in contact with the mesh surface may itself force particles through the mesh by scraping particles off onto the individual mesh elements.

Thus, an improved fine, dry powder screening mechanism has been disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A dry material vibratory screen structure, comprising a vibratory housing;

a first screening element fixed to said vibratory housing in a substantially horizontal orientation;

a second screening element fixed to said vibratory housing and extending parallel to and below said first screening element, said second screening element having a much finer mesh than said first screening element;

sliders positioned directly on said second screening element between said first and second screening elements, each said slider having a lower surface in contact with said lower screening element and extending substantially but not fully between said first and second screening elements; and a discharge opening laterally from between said first and second screening elements through said housing.

* * * * *